US005766446A

United States Patent [19]

Spindt et al.

[11] Patent Number: 5,766,446

[45] Date of Patent: Jun. 16, 1998

[54] ELECTROCHEMICAL REMOVAL OF MATERIAL, PARTICULARLY EXCESS EMITTER MATERIAL IN ELECTRON-EMITTING DEVICE

[75] Inventors: Christopher J. Spindt, Menlo Park; Gabriela S. Chakarova, San Jose, both of Calif.; Maria S. Nikolova; Peter C. Searson, both of Baltimore, Md.; Duane A. Haven, Cupertino, Calif.; Nils Johan Knall, Palo Alto, Calif.; John M. Macaulay, Palo Alto, Calif.; Roger W. Barton, Palo Alto, Calif.

[73] Assignee: Candescent Technologies Corporation, San Jose, Calif.

[21] Appl. No.: 610,729

[22] Filed: Mar. 5, 1996

[51] Int. Cl.[6] ..... C25F 3/00

[52] U.S. Cl. ..... 205/640; 205/652; 205/674

[58] Field of Search ..... 205/666, 667, 205/640, 674, 652

[56] References Cited

U.S. PATENT DOCUMENTS

| | | | |
|---|---|---|---|
| 2,334,699 | 11/1943 | Faust . | |
| 3,174,920 | 3/1965 | Post | 205/666 X |
| 3,407,125 | 10/1968 | Fehlner . | |
| 3,483,108 | 12/1969 | Schaefer | 205/666 X |
| 3,665,241 | 5/1972 | Spindt et al. . | |
| 3,755,704 | 8/1973 | Spindt et al. . | |
| 3,998,678 | 12/1976 | Fukase et al. . | |
| 4,008,412 | 2/1977 | Yuito et al. . | |
| 4,208,257 | 6/1980 | Hom-ma et al. | 205/666 X |

(List continued on next page.)

FOREIGN PATENT DOCUMENTS

| | | |
|---|---|---|
| 0234989 A1 | 9/1987 | European Pat. Off. . |
| 0697710 A1 | 2/1996 | European Pat. Off. . |
| 0708473 A1 | 4/1996 | European Pat. Off. . |
| WO 95/07543 | 3/1995 | WIPO . |
| WO 96/06443 | 2/1996 | WIPO . |

OTHER PUBLICATIONS

Brodie et al, "Vacuum Microelectronics," *Advances In Electronics And Electron Physics*, vol. 83, 1992, pp. 1–106. (no month).

Busta, "Vacuum Microelectronics—1992," *J. Micromech. Microeng.*, vol. 2, 1992, pp. 43–74. (no month).

Cochran et al, "Low–voltage Field Emission from Tungsten Fiber Arrays in a Stabilized Zirconia Matrix," *J. Mater. Res.*, May/Jun. 1987, pp. 322–328.

Datta et al, "Film Breakdown on Nickel under Transpassive Dissolution Conditions in Sodium Nitrate Solutions," *J. Electrochem. Soc.: Electrochemical Science and Technology*, Apr. 1977, vol. 124, No. 4, pp. 483–489.

Datta et al., "On the Influence of Electrolyte Concentration, pH and Temperature on Surface Brightening of Nickel under ECM Conditions," *J. Applied Electro–chemistry*, 1977, pp. 247–252.

(List continued on next page.)

*Primary Examiner*—Donald R. Valentine

*Attorney, Agent, or Firm*—Skjerven, Morrill, MacPherson, Franklin & Friel LLP; Ronald J. Meetin

[57] ABSTRACT

An electrochemical technique is employed for removing certain material from a partially finished structure without significantly chemically attacking certain other material of the same chemical type as the removed material. The partially finished structure contains a first electrically non-insulating layer (52C) consisting at least partially of first material, typically excess emitter material that accumulates during the deposition of the emitter material to form electron-emissive elements (52A) in an electron emitter, that overlies an electrically insulating layer (44). An electrically non-insulating member, such as an electron-emissive element, consisting at least partially of the first material is situated at least partly in an opening (50) extending through the insulating layer. With the partially finished structure so arranged, at least part of the first material of the first non-insulating layer is electrochemically removed such that the non-insulating member is exposed without significantly attacking the first material of the non-insulating member.

51 Claims, 6 Drawing Sheets

U.S. PATENT DOCUMENTS

| | | | |
|---|---|---|---|
| 4,952,272 | 8/1990 | Okino et al. | 205/666 X |
| 5,007,873 | 4/1991 | Goronkin et al. . | |
| 5,053,673 | 10/1991 | Tomii et al. . | |
| 5,170,092 | 12/1992 | Tomii et al. . | |
| 5,185,057 | 2/1993 | Playdon . | |
| 5,188,977 | 2/1993 | Stengl et al. . | |
| 5,199,917 | 4/1993 | MacDonald et al. . | |
| 5,217,586 | 6/1993 | Datta et al. . | |
| 5,256,565 | 10/1993 | Bernhardt et al. . | |
| 5,277,638 | 1/1994 | Lee . | |
| 5,424,605 | 6/1995 | Lovoi . | |
| 5,458,520 | 10/1995 | DeMercurio et al. . | |
| 5,462,467 | 10/1995 | Macaulay et al. . | |
| 5,477,105 | 12/1995 | Curtin et al. . | |
| 5,559,389 | 9/1996 | Spindt et al. . | |
| 5,564,959 | 10/1996 | Spindt et al. . | |
| 5,589,731 | 12/1996 | Fahlen et al. . | |

OTHER PUBLICATIONS

Datta et al, "On the Role of Mass Transport in High Rate Dissolution of Iron and Nickel in ECM Electrolytes–I. Chloride Solutions," *Electrochimica Acta,* 1980, vol. 25, pp. 1255–1262.

Datta et al, "Surface Brightening During High Rate Nickel Dissolution in Nitrate Electrolytes," *J. Electrochem. Soc.: Electrochemical Science and Technology,* NOv. 1975, pp. 1466–1472.

Huang et al, "200–nm Gated Field Emitters", *IEEE Electron Device Letters,* Mar. 1993, pp. 121–122.

LaBoda et al, "ECM of Nickel in $NaClO_3$ Solution," *J. Electrochem. Soc.: Electrochemical Science and Technology,* vol. 120, No. 5, May 1973, pp. 643–646.

Landolt et al, "High Rate Anodic Dissolution of Copper," *J. Electrochem. Soc.: Electrochemical Science,* vol. 116, No. 10, Oct. 1969, pp. 1384–1390.

Penner et al, "Preparation and Electrochemical Characterization of Ultramicroelectrode Ensembles," *Anal. Chem.,* 1 Nov. 1987, pp. 2625–2630.

Spindt, "A Thin–Film Field–Emission Cathode," *J. App. Phys,* vol. 39, Feb. 1968, pp. 3504–3505.

Spindt et al, "Physical Properties of Thin–film Field Emission Cathodes with Molybdenum Cones," *J. App. Phys,* Dec. 1976, pp. 5248–5263.

Spindt et al, "Research in Micron–size Field–emission Tubes," *IEEE Conf. Record, 1966 Eighth Conf. Tube Techniques,* 20–22 Sep. 1966, pp. 143–147.

ELECTROCHEMICAL REMOVAL OF MATERIAL, PARTICULARLY EXCESS EMITTER MATERIAL IN ELECTRON-EMITTING DEVICE

FIELD OF USE

This invention relates to removing undesired portions of material from partially finished structures without removing desired portions of the same type of material, especially when the structures are electron-emitting devices, commonly referred to as cathodes, suitable for products such as cathode-ray tube ("CRT") displays of the flat-panel type.

BACKGROUND ART

An area field-emission cathode (or field emitter) contains a group of electron-emissive elements that emit electrons upon being subjected to an electric field of sufficient strength. The electron-emissive elements are typically situated over a patterned emitter electrode layer. In a gated field emitter, a patterned gate layer typically overlies the emitter layer at the locations of the electron-emissive elements. Each electron-emissive element is exposed through an opening in the gate layer. When a suitable voltage is applied between a selected portion of the gate layer and a selected portion of the emitter layer, the gate layer extracts electrons from the electron-emissive elements at the intersection of the two selected portions.

The electron-emissive elements in a gated field emitter for a flat-panel CRT display are often shaped as cones. Various methods have been investigated in the prior art for creating conical electron-emissive elements. Referring to the drawings, FIGS. 1*a*–1*d* (collectively "FIG. 1") illustrate one such conventional technique as, for example, disclosed in Spindt et al, U.S. Pat. No. 3,755,704.

At the stage shown in FIG. 1*a*, the partially finished field emitter consists of an electrically insulating substrate 20, an emitter electrode layer 22, an intermediate dielectric layer 24, and a gate layer 26. Gate openings 28 extend through gate layer 26. Corresponding, somewhat wider dielectric openings 30 extend through dielectric layer 24 down to emitter layer 22.

A lift-off layer 32 is formed on top of gate layer 26 by depositing a suitable lift-off material at a grazing angle relative to the upper surface of gate layer 26 while rotating the structure, relative to the source of the lift-off material, about an axis generally perpendicular to the upper surface of layer 26. See FIG. 1*b*. Small portions of the lift-off material accumulate on the side edges of gate layer 26 along gate openings 28. This reduces the diameters of the apertures through which emitter layer 22 is exposed.

Emitter material, typically molybdenum, is deposited on top of the structure and into dielectric openings 30 in such a way that the apertures through which the emitter material enters openings 30 progressively close. In U.S. Pat. No. 3,755,704, a simultaneous deposition of a molybdenum-alumina composite is described as being performed at a grazing angle relative to the upper surface of gate layer 26 to help close the apertures through which the emitter material enters openings 30. Generally conical electron-emissive elements 34A are thereby formed in composite openings 28/30 over emitter layer 22. See FIG. 1*c*. A continuous layer 34B of the emitter/closure material forms on top of gate layer 26. Lift-off layer 32 is subsequently removed so as to lift-off excess emitter/closure-material layer 34B. FIG. 1*d* shows the resultant structure.

Using lift-off layer 32 to remove excess emitter/closure-material layer 34B is disadvantageous for various reasons.

The presence of portions of the lift-off material along the edges of gate layer 26 can make it difficult to scale down electron-emissive elements 34A. Performing a deposition at a grazing angle while rotating the body, relative to the deposition source, about an axis generally perpendicular to the body's upper surface, as is done in creating lift-off layer 32, becomes increasingly difficult as the body's lateral area increases. Consequently, the use of lift-off layer 32 presents an impediment to scaling up the lateral area of the field emitter.

The lift-off material deposition must be performed carefully so as to assure that none of the lift-off material accumulates on emitter layer 22 and causes cones 34A to be lifted off during the lift-off of excess layer 34B. Since layer 34B is removed as an artifact of removing lift-off layer 32, particles of the removed emitter material can contaminate the field emitter. Furthermore, deposition of the lift-off material takes fabrication time and therefore money. In fabricating a gated field emitter having conical electron-emissive elements, it would be desirable to have a technique for removing a layer that contains excess emitter material without utilizing a lift-off layer.

GENERAL DISCLOSURE OF THE INVENTION

The present invention furnishes such a technique. In the invention, an electrochemical procedure is employed for removing certain material from a structure without significantly chemically attacking, and thus without significantly removing, certain other material of the same chemical type as the removed material.

No lift-off layer needs to be utilized in electrochemically removing material according to the invention. The number of processing steps is typically reduced, thereby saving fabrication time and money. When the electrochemical technique of the invention is utilized to remove emitter material that accumulates on a gate layer of an electron emitter during the deposition of the emitter material through openings in the gate layer to form electron-emissive elements, the invention avoids the emitter-material particulate contamination problem that can occur with use of a lift-off layer.

The invention alleviates the problems that using a lift-off layer creates in scaling down electron-emissive elements and in scaling up the lateral area of the electron emitter. The possibility of lifting off electron-emissive elements due to the use of a lift-off layer is avoided in the invention. The electrochemical removal technique of the invention thereby enables fabrication of the electron-emissive elements to be completed in an efficient, economical manner.

In the present electrochemical removal procedure, the first step is to provide a starting structure in which a first electrically non-insulating layer consisting at least partially of first material overlies an electrically insulating layer. As discussed below, "electrically non-insulating" means electrically conductive or electrically resistive. The first non-insulating layer could, for example, be a layer containing excess emitter material that accumulates during the deposition of emitter material to form electron-emissive elements in an electron emitter.

An opening extends through the insulating layer. An electrically non-insulating member—e.g. an electron-emissive element—consisting at least partially of the first material is situated at least partly in the opening. The non-insulating member is spaced apart from the first non-insulating layer. With the starting structure so arranged, at least part of the first material of the first non-insulating layer is electrochemically removed such that the non-insulating member is exposed without significantly chemically attacking the first material of the non-insulating member.

The electrochemical removal operation is normally performed with an electrochemical cell containing an electrolyte to which the structure is subjected. The operation of the electrochemical cell is regulated by a control system having a working-electrode conductor and a first counter-electrode conductor. The working-electrode conductor is electrically coupled to the first non-insulating layer. The first counter-electrode is electrically coupled to the non-insulating member. The control system also usually has a second counter-electrode conductor electrically coupled to a counter electrode which is at least partly situated in the electrolyte spaced apart from the starting structure. The second counter-electrode conductor, and therefore the counter electrode, are maintained at a controlled potential, typically zero, relative to the first counter-electrode conductor.

The starting structure typically includes a second electrically non-insulating layer—e.g., a gate layer—situated between the first non-insulating layer and the insulating layer. An opening continuous with the opening through the insulating layer extends through the second non-insulating layer. The non-insulating member is also spaced apart from the second non-insulating layer. When the structure includes the second non-insulating layer, the electrochemical removal step is performed under such conditions that the second non-insulating layer is not substantially chemically attacked during the removal step. Also, the first counter-electrode conductor is typically coupled to the non-insulating layer by way of a lower electrically non-insulating region—e.g., a lower emitter region—provided below the insulating layer.

More particularly, when the present electrochemical removal technique is employed in fabricating a gated electron emitter, a structure is first provided in which an electrically non-insulating gate layer overlies an electrically insulating layer situated over a lower electrically non-insulating emitter region. A multiplicity of composite openings extend through the gate and insulating layers substantially down to the lower emitter region. A corresponding multiplicity of electron-emissive elements, each consisting at least partially of primary electrically non-insulating emitter material, are respectively situated in the composite openings. Each electron-emissive element is electrically coupled to the lower emitter region but is spaced apart from the gate layer.

A layer consisting at least partially of excess primary emitter material overlies, and is electrically coupled to, the gate layer. As with the gate layer, the excess emitter-material layer is spaced apart from each electron-emissive element. The excess emitter-material layer is typically created as a by-product of depositing the primary emitter material into the composite openings to form the electron-emissive elements.

The electrochemical removal procedure of the invention is utilized to remove at least part, typically all, of the excess emitter-material layer without significantly chemically attacking the primary emitter material of the electron-emissive elements and also without substantially chemically attacking the gate layer. In particular, the selectivity of the present electrochemical technique to not attacking the primary emitter material of the electron-emissive elements is normally considerably greater than the selectivity to not attacking the gate layer.

In a preferred embodiment, the primary emitter material consists primarily of molybdenum, while the gate layer consists of chromium or/and nickel. The working electrode is maintained at a substantially constant driving potential in the range of 0.4–1.0 volt referenced to a Normal Hydrogen Electrode. The electrolyte contains 0.005–0.5 molar metal hydroxide and 0.005–3.0 molar metal nitrate. For both the hydroxide and nitrate, the metal is one or more of lithium, sodium, potassium, rubidium, and cesium. This selection of materials and parameters is especially appropriate to the fabrication of large-area electron emitters for flat-panel CRT displays.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

The present invention utilizes an electrochemical technique to remove excess emitter material in creating electron-emissive elements for a gated field-emission cathode. Each such field emitter is suitable for exciting phosphor regions on a faceplate in a cathode-ray tube of a flat-panel device such as a flat-panel television or a flat-panel video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/μm.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites, such as cermet (ceramic with embedded metal particles), (b) forms of carbon such as graphite, amorphous carbon, and modified (e.g. doped or laser-modified) diamond, (c) and certain silicon-carbon compounds such as silicon-carbon-nitrogen.

The values of potentials that arise in performing the electrochemical removal technique of the invention are, for convenience, defined with respect to the standard hydrogen electrode scale of the International Union of Pure and Applied Chemists. This standard is termed a Normal Hydrogen Electrode herein.

Figure 1A:
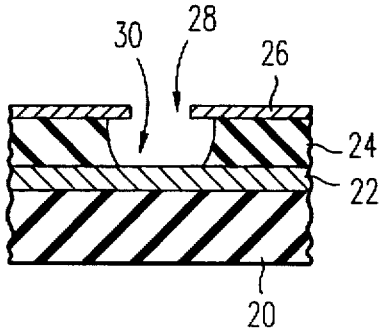
FIG. 1a PRIOR ART
FIGS. 1*a*–1*d* are cross-sectional structural views representing steps in a prior art process for creating electron-emissive elements in an electron emitter.
Figure 1B:
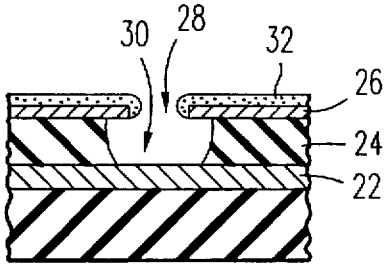
FIG. 1b PRIOR ART
Figure 1C:
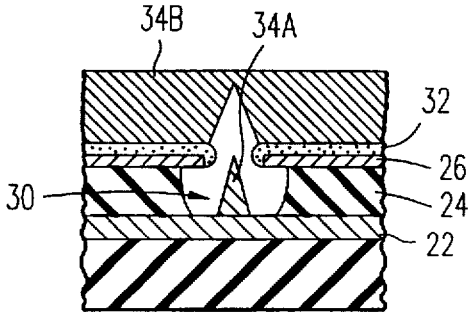
FIG. 1c PRIOR ART
Figure 1D:
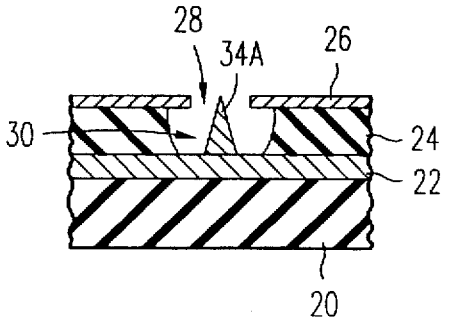
FIG. 1d PRIOR ART
Figure 2A:
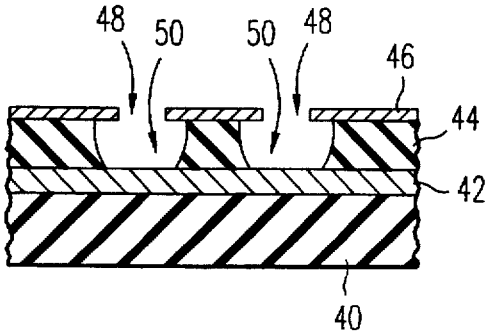
FIGS. 2*a*–2*c* are cross-sectional views representing steps in a process sequence that follows the invention's electrochemical teachings for creating conical electron-emissive elements in a gated field emitter.
Figure 2B:
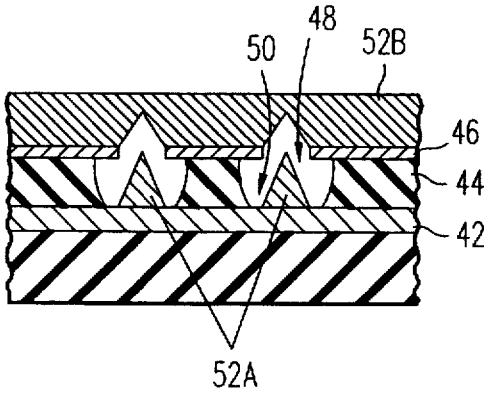
Figure 2C:
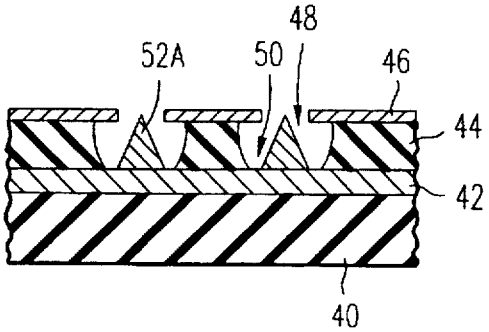

FIGS. 2*a*–2*c* (collectively "FIG. 2") illustrate how an electrochemical technique is utilized in accordance with the invention to remove excess emitter material during the creation of electron-emissive elements for a gated field emitter. The starting point in the procedure of FIG. 2 is an electrically insulating substrate 40 typically formed with ceramic or glass. See FIG. 2*a*. Substrate 40, which provides support for the field emitter, is configured as a plate. In a flat-panel CRT display, substrate 40 constitutes at least part of the backplate.

A lower electrically non-insulating emitter electrode region 42 is provided along the top of substrate 40. As described below, lower non-insulating region 42 is typically formed with a lower electrically conductive layer and an upper electrically resistive layer. The lower conductive layer consists of metal such as nickel or aluminum. The upper resistive layer is formed with cermet or a silicon-carbon-nitrogen compound.

Lower non-insulating region 42 may be configured in various ways. At least part of non-insulating region 42 is typically patterned into a group of generally parallel emitter-electrode lines referred to as row electrodes. When non-insulating region 42 is configured in this way, the final field-emission cathode is particularly suitable for exciting light-emitting phosphor elements in a flat-panel CRT display. Nonetheless, non-insulating region 42 can be arranged in other patterns, or can even be unpatterned.

A largely homogenous electrically insulating layer 44, which serves as the emitter/gate interelectrode dielectric, is provided on top of the structure. The thickness of insulating layer 44 is normally in the range of 0.2–3 μm. More specifically, layer 44 has a thickness of 200 nm–500 nm, typically 300 nm. Insulating layer 44 typically consists of silicon oxide or silicon nitride. Although not shown in FIG. 2*a*, parts of insulating layer 44 may contact substrate 40 depending on the configuration of lower non-insulating region 42.

An electrically non-insulating gate layer 46 consisting of selected gate material is situated on interelectrode dielectric layer 44. Gate layer 46 normally has a thickness in the range of 30–500 nm. More particularly, the gate thickness is 30–50 nm, typically 40 nm. The gate material is normally metal, preferably chromium or/and nickel. Alternative candidates for the gate material include molybdenum, platinum, niobium, tantalum, titanium, tungsten, and titanium-tungsten.

Gate layer 46 may be patterned into a group of gate lines running perpendicular to the emitter row electrodes of lower non-insulating region 22. The gate lines then serve as column electrodes. With suitable patterning applied to gate layer 46, the field emitter may alternatively be provided with separate column electrodes that contact portions of layer 46 and extend perpendicular to the row electrodes. A multiplicity of generally circular openings 48 extend through gate layer 46. Although the diameters of gate openings 48 depend on how openings 48 are created, the gate opening diameter is normally in the range of 0.1–2 μm. More specifically, the gate opening diameter is 100–400 nm, typically 300 nm.

A multiplicity of generally circular dielectric openings (or dielectric open spaces) 50 extend through insulating layer 44 down to lower emitter region 42. Each dielectric opening 50 is vertically aligned to a corresponding one of gate openings 48 to form a composite opening 48/50 that exposes part of lower non-insulating region 42. Each dielectric open space 50 is somewhat wider than corresponding gate opening 48. Consequently, insulating layer 44 undercuts gate layer 46 along composite openings 48/50.

Various techniques can be employed to form composite openings 48/50 in layers 44 and 46. For example, openings 48/50 can be created by etching gate layer 46 through apertures in a mask, typically photoresist, to form gate openings 48 and then etching insulating layer 44 through openings 48 to create dielectric open spaces 50. Composite openings 48/50 can also be created by using etched charged-particle tracks as described in Macaulay et al, PCT Patent Publication WO 95/07543.

A micro-machining or selective etching technique of the type described in U.S. Pat. No. 3,755,704, cited above, can be utilized to form composite openings 48/50. Subject to different nomenclature and different materials, openings 48/50 can be formed according to the sphere-based procedure described in Spindt et al, "Research in Micron-Size Field-Emission Tubes," *IEEE Conf. Rec.* 1966 *Eighth Conf. on Tube Techniques*, 20 Sep. 1966, pages 143–147.

Electrically non-insulating emitter cone material is evaporatively deposited on top of the structure in a direction generally perpendicular to the upper surface of insulating layer 44 (or gate layer 46). The emitter cone material accumulates on gate layer 46 and passes through gate openings 48 to accumulate on lower non-insulating region 42 in dielectric open spaces 50. Due to the accumulation of the cone material on gate layer 46, the openings through which the cone material enters open spaces 50 progressively close. The deposition is performed until these openings fully close. As a result, the cone material accumulates in dielectric open spaces 50 to form corresponding conical electron-emissive elements 52A as shown in FIG. 2*b*. A continuous (blanket) layer 52B of the cone material is simultaneously formed on gate layer 46.

The emitter cone material is normally metal, preferably molybdenum when gate layer 46 consists of chromium or/and nickel. Alternative candidates for the cone material include nickel, chromium, platinum, niobium, tantalum, titanium, tungsten, titanium-tungsten, and titanium carbide subject to the cone material differing from the gate material.

Using a suitable photoresist mask (not shown), one or more portions of excess emitter-material layer 52B along the lateral periphery of the partially finished field-emission structure are removed. Consequently, parts of gate layer 46—i.e., parts of the gate lines or gate portions that form gate layer 46—and/or parts of the separate column electrodes (when present) that contact the gate lines or gate portions are exposed along the lateral periphery of the field emitter. Selected internal portions of the gate lines or gate portions and/or the column electrodes are also typically exposed during the masked etch.

Figure 3:
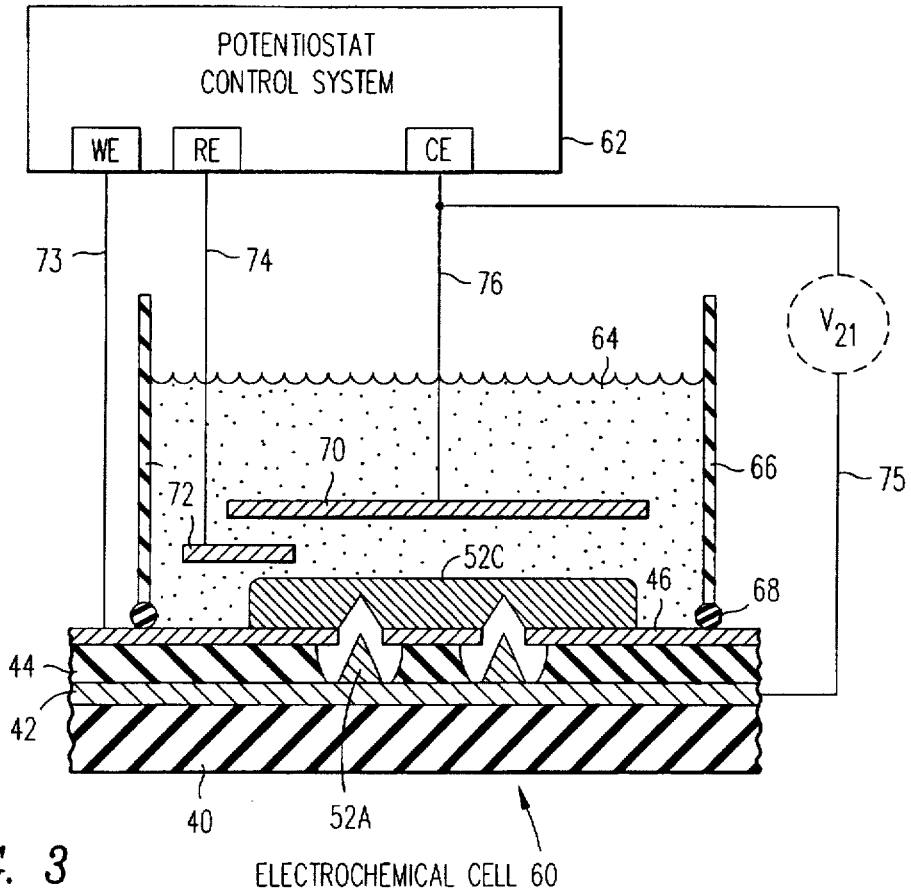
FIG. 3 is a cross-sectional schematic view of a potentiostatic electrochemical cell utilized in the procedure of FIG. 2.

An electrochemical removal operation is now performed on the so-etched structure of FIG. 2*b* utilizing a potentiostatic electrochemical system of the type schematically shown in FIG. 3. Item 52C in FIG. 3 is the portion of excess emitter-material layer 52B remaining after the masked etch described in the preceding paragraph. During the electrochemical operation, excess emitter-material layer 52C is removed without significantly chemically attacking conical electron-emissive elements 52A and without substantially chemically attacking patterned gate layer 46 and (when present) the separate column electrodes.

A small loss in the volume of gate layer 46 and the optional separate column electrodes can normally be tolerated. However, the remove of a comparable (small) volume of cones 52A can be quite damaging. Accordingly, the present electrochemical removal technique is performed under such conditions that the selectivity of removing the emitter material of excess layer 52B to removing the emitter material of cones 52A is much higher than the selectivity of removing the emitter material of excess layer 52B to removing the gate material and (when present) the material of the separate column electrodes. Alternatively stated, the selectivity of not removing the emitter material of cones 52A is much greater than both the selectivity of not removing the gate material and, when separate column electrodes are employed, the selectivity of not removing the column-electrode material.

The electrochemical system is formed with an electrochemical cell 60 and a control system 62 in the form of a potentiostat that regulates the cell operation. Electrochemical cell 60 consists of electrolyte 64, a surrounding wall 66, an O-ring 68, a counter electrode 70, and a reference electrode 72. Electrolyte 64 consists of an electrolytic bath that contacts excess emitter-material layer 52C and gate layer 46 along the top of the partially finished field emitter. O-ring 68 prevents electrolyte 64 from leaking out of cell 60 at the bottom of wall 66.

Counter electrode 70, typically platinum, is immersed in electrolyte 64 and extends parallel to excess emitter-material layer 52C. Reference electrode 72, typically silver/silver chloride, is situated in electrolyte 64, preferably close to layer 52C.

Control system 62 has a working-electrode terminal WE, a reference-electrode terminal RE, and a counter-electrode terminal CE. Cell 60 is electrically connected to control system 62 by a working-electrode conductor 73, a reference-electrode conductor 74, a first counter-electrode conductor 75, and a second counter-electrode conductor 76. Conductors 73–76 all typically consist of copper wire.

Working-electrode conductor 73 is electrically coupled to the lines/portions of gate layer 46, either directly as shown in FIG. 3 or by way of separate column electrodes. Conductor 73 normally makes its electrical connections at the outside of cell 60 as depicted in FIG. 3. Since gate layer 46 is in contact with excess emitter-material layer 52C, the combination of layers 46 and 52C and (when present) the separate column electrodes forms a working anode electrode for cell 60. Reference-electrode conductor 74 is electrically connected to reference electrode 72.

First counter-electrode conductor 75 is electrically coupled to the emitter-electrode lines of lower non-insulating region 42 along the outside of cell 60. Second counter-electrode conductor 76 normally connects first counter-electrode conductor 75 to counter electrode 70. Consequently, counter electrode 70 and conductor 76 are normally at the same potential as conductor 75. Nonetheless, a potential source 78, indicated by dashed lines in FIG. 3, may be inserted between conductors 75 and 76 for maintaining conductor 76, and thus counter electrode 70, at a selected different potential $V_{21}$ relative to conductor 75. When potential source 78 is present, potential $V_{21}$ may be positive or negative. However, the potential of electron-emissive cones 52A should not be so negative as to cause the emitter material from excess layer 52C to plate out on cones 52A.

Electrochemical cell 60 operates in a potentiostatic (constant-potential) mode. Reference electrode 72 provides a highly reproducible fixed reference potential $V_R$. When electrode 72 is a silver/silver chloride reference electrode, reference potential $V_R$ is 0.21 volt relative to a Normal Hydrogen Electrode.

A potentiostat is used as control system 62 for applying a constant anodic potential $V_A$, versus reference electrode 72, at excess layer 52C where excess emitter material is removed during the electrochemical removal process. Referenced to a Normal Hydrogen Electrode, the potential $V_{WE}$ at excess emitter-material layer 52C is $V_A+V_R$.

Inasmuch as electron-emissive cones 52A contact lower emitter region 42, cones 52A and region 42 are at a negative potential relative to the working electrode. Likewise counter electrode 70 is at a negative potential compared to the working electrode. Cones 52A, lower emitter region 42, and counter electrode 70 serve as the cathode for cell 60.

For the case in which the emitter material of cones 52A and excess layer 52C is molybdenum, while the material of patterned gate layer 46 and the adjoining column electrodes (when present) is chromium or/and nickel, electrolyte 62 preferably is an aqueous solution containing:

a. Sodium hydroxide (NaOH) at a molar concentration (moles/liter) of 0.005–0.05, preferably 0.01, and b. Sodium nitrate ($NaNO_3$) at a molar concentration of 0.005–3.0, preferably 2.0.

At the preferred 0.01-mole NaOH and 2.0-mole $NaNO_3$ values, applied potential $V_A$ is set at a suitable value on control system 62 to fix cell driving potential $V_{WE}$ at a value in the range of 0.4–1.0 volt, typically 0.8 volt, referenced to a Normal Hydrogen Electrode. Counter-to-blocking potential difference $V_{21}$ is preferably zero.

With electrochemical cell 60 being operated at the preceding conditions, excess emitter-material layer 52C is electrochemically removed from the top of the structure. In particular, the driving force provided by anodic potential $V_{WE}$ causes the molybdenum in excess layer 52C to be anodically dissolved in electrolyte 64, typically as $Mo^{6+}$ ions. The sodium nitrate is used to adjust the rate at which the molybdenum in layer 52C is oxidized and therefore removed from the field-emission structure. The $NO_3^-$ ions produced by dissociation of $NaNO_3$ act as the oxidizing agent. Increasing the $NaNO_3$ concentration increases the rate at which the molybdenum in layer 52C is oxidized, and vice versa. Reduction of hydrogen ions ($H^+$) occurs at counter electrode 70 to produce hydrogen gas.

Substantially no chemical activity occurs at the surfaces of cones 52A electrically coupled to counter-electrode conductor 75. The low cathodic potential on conductor 75, relative to anodic potential $V_{WE}$, prevents the molybdenum in cones 52A from being dissolved.

Some chemical reactions may occur along the uncovered portions of lower emitter region 42 exposed through dielectric openings 50. However, the amount of chemical activity along these uncovered portions of emitter region 42 is guite low.

In an electrochemical removal cell, the (positive) anodic current $I_{WE}$ that flows through the working electrode is indicative of the rate at which material is electrochemically removed from a structure subjected to the electrolyte and driving potential. The removal rate normally increases with increasing anodic current $I_{WE}$.

Figure 4:
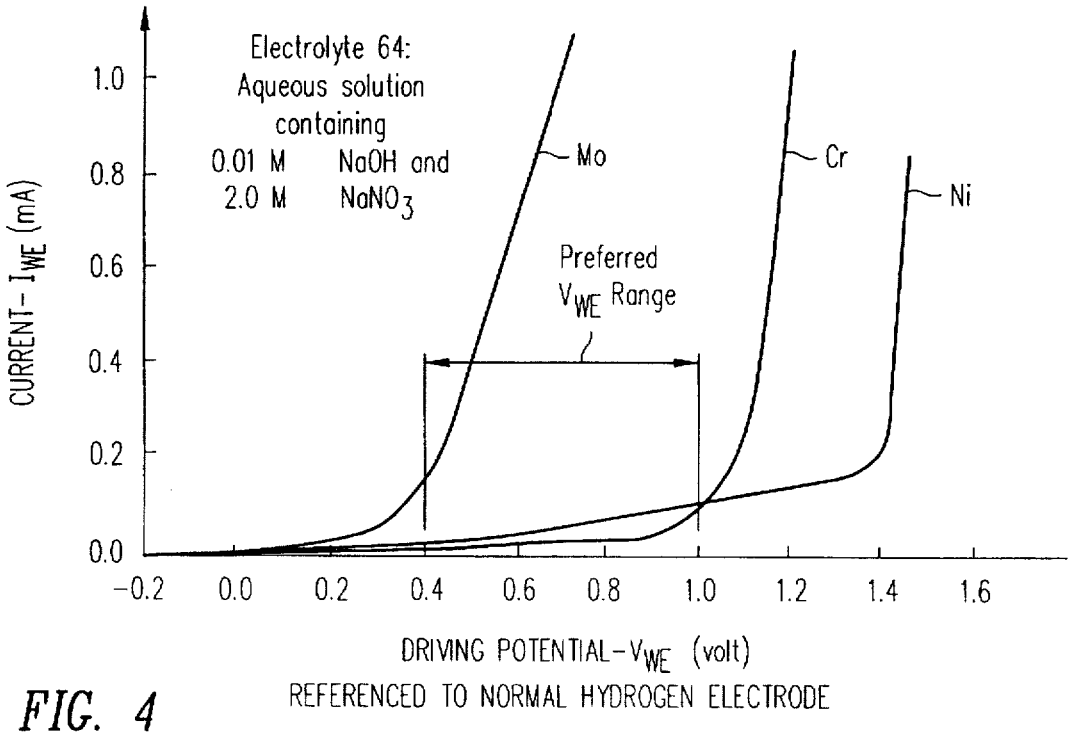
FIG. 4 is a graph of cell current as a function of driving voltage for electrochemically removing certain metals in a potentiostatic electrochemical cell of the type shown in FIG. 3.

The preferred $V_{WE}$ potential range given above at the preferred 0.01-mole NaOH and 2.0-mole $NaNO_3$ values was determined by experimentally monitoring anodic polarization curves (current $I_{WE}$ as a function of applied driving potential $V_{WE}$) for an electrochemical cell separately configured to remove specimens of molybdenum, chromium, and nickel. FIG. 4 illustrates the experimental results, indicating that the removal rates for chromium and nickel are very small compared to the removal rate for molybdenum when driving potential $V_{WE}$ is in the range of 0.4–1.0 volt referenced to a Normal Hydrogen Electrode.

Figure 5A:
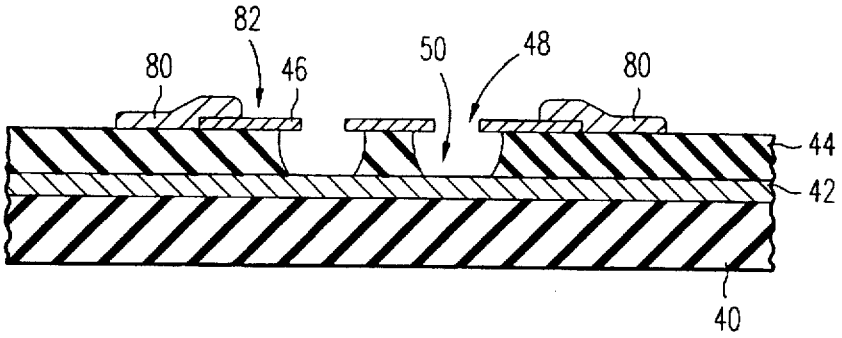
FIGS. 5*a*–5*d* are cross-sectional structural views representing steps in an implementation of the process sequence of FIG. 2.

FIGS. 5*a*–5*d* (collectively "FIG. 5") illustrate an implementation of the process sequence of FIG. 3 for the case in which the field emitter is provided with separate column electrodes 80 that contact patterned gate layer 46. FIG. 5*a* depicts one such column electrode 80 that extends perpendicular to the plane of the figure. A group of column-electrode apertures 82, one of which is shown in FIG. 5*a*, extend through each column electrode 80. Each column-electrode aperture 82 exposes a multiplicity of composite openings 48/50. The emitter-electrode lines of lower non-insulating region 42 in FIG. 5*a* extend horizontally parallel to the plane of the figure.

Figure 5B:
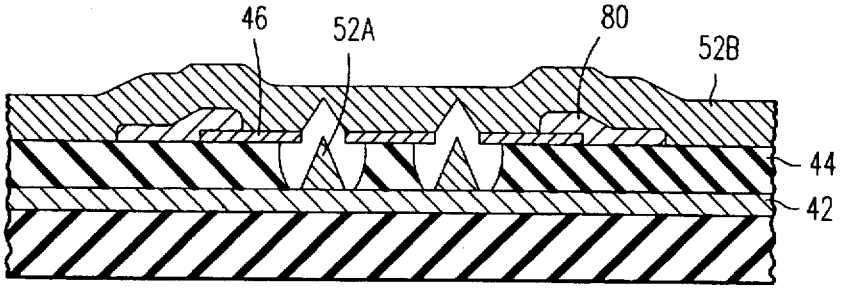

The appearance of the partially finished field-emission structure after the deposition of cones 52A and blanket excess emitter-material layer 52B is shown in FIG. 5*b*. In addition to contacting the portions of gate layer 46 previously exposed through column-electrode apertures 82, excess layer 52B is situated on column electrodes 80 and on parts of insulating layer 44.

Figure 5C:
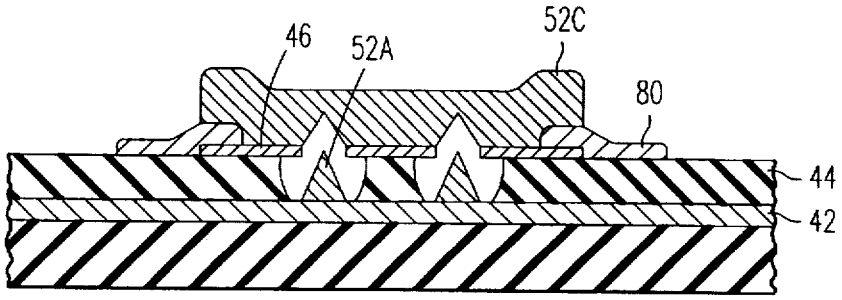
Figure 6A:
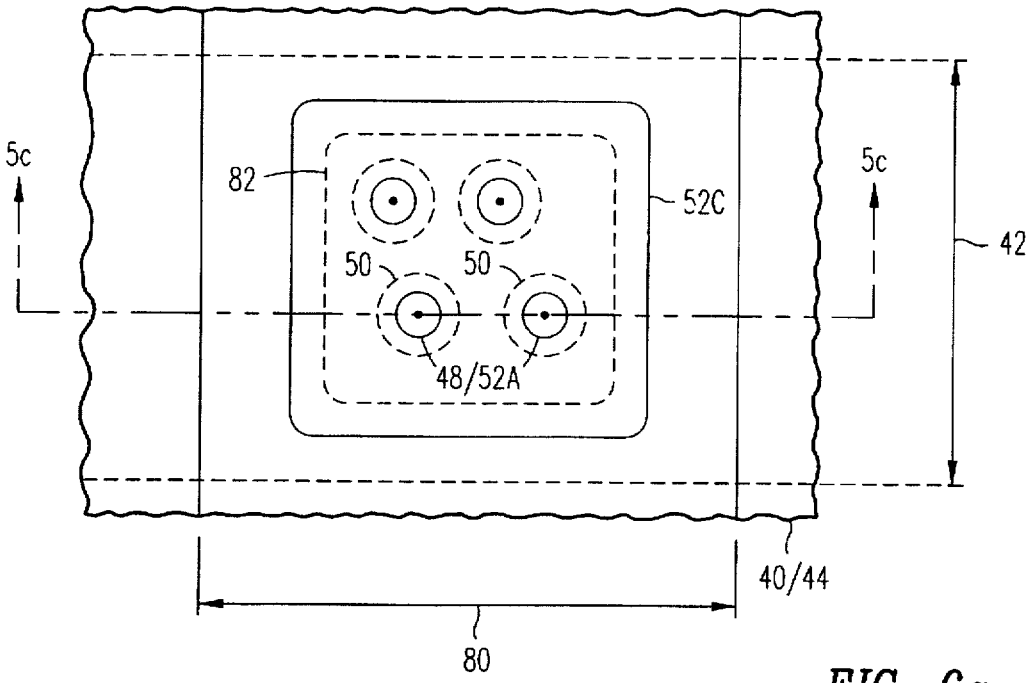
FIGS. 6*a* and 6*b* are layout views of the respective structures in FIGS. 5*c* and 5*d*. The cross section of FIG. 5*c* is taken through plane 5*c*—5*c* in FIG. 6*a*. The cross section of FIG. 5*d* is taken through plane 5*d*—5*d* in FIG. 6*b*.

FIG. 5*c* illustrates how the structure appears after performing the masked etch to remove part of excess emitter-material layer 52B, including excess emitter material situated along the lateral periphery of the structure. The remainder of excess layer 52B consists of a group of rectangular islands 52C that overlie corresponding portions of gate layer 46. A layout (plan) view of FIG. 5*c* is depicted in FIG. 6*a*. By using the same reticle to create the photoresist mask employed in forming excess emitter-material islands 52C as used in patterning the gate material to form patterned gate layer 46, the outside boundary of each island 52C is generally in vertical alignment with the outside boundary of the underlying portion of gate layer 46.

Figure 5D:
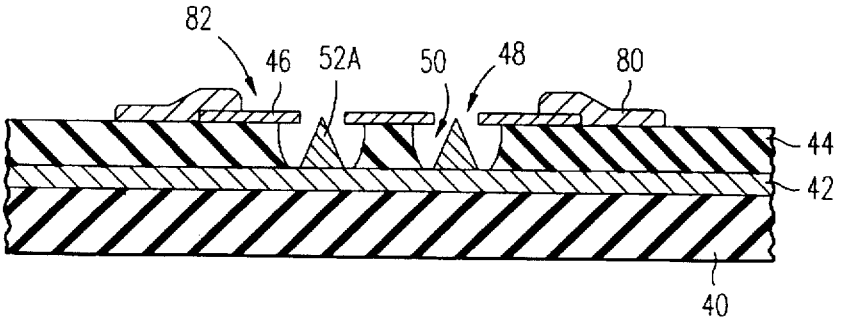
Figure 6B:
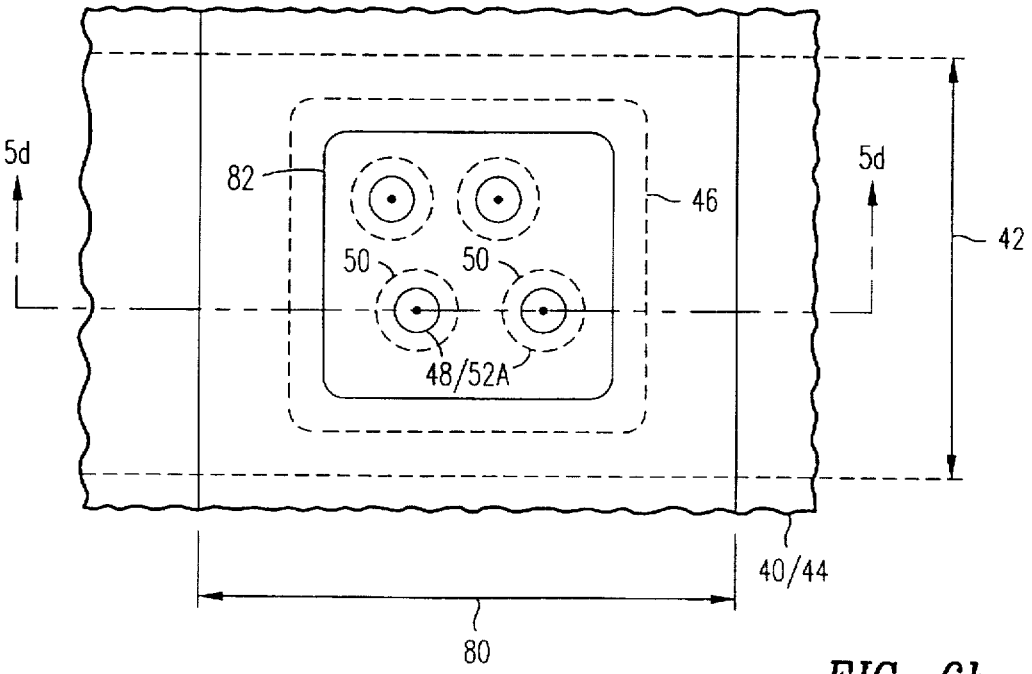

FIG. 5*d* illustrates the appearance of the structure after electrochemically removing each island 52C. As indicated in FIG. 5*d*, neither gate layer 46 nor column electrodes 80 are substantially chemically attacked during the removal of layers 52C. Similarly, cones 52A are not significantly chemically attacked during the electrochemical removal operation, the attack (if any) on cones 52A being much less than the (very small) attack on layer 46 and electrodes 80. A layout view corresponding to the structure of FIG. 5*a* is depicted in FIG. 6*b*.

Figure 7:
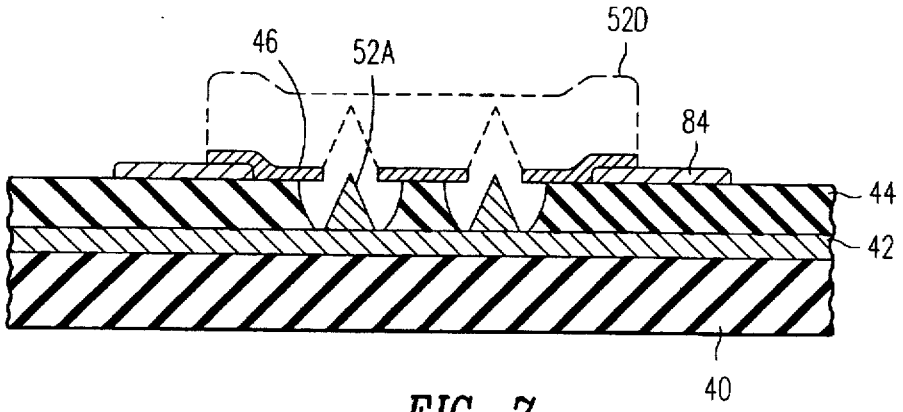
FIG. 7 is a cross-sectional structural view of a structure produced according to another implementation of the process sequence of FIG. 2.

In the process sequence of FIG. 5, column electrodes 80 are situated on parts of patterned gate layer 46. Alternatively, gate layer 46 can overlie portions of the column electrodes. FIG. 7 depicts such an alternative in which gate layer 46 extends partly over a group of column electrodes 84 extending perpendicular to the plane of the figure. Item 52D, shown in dashed line in FIG. 7, indicates the remainder of excess emitter-material layer 52B after the masked patterning etch. The shape of excess layer 52D is nearly the same as a shape of excess layer 52C in the process sequence of FIG. 5*c*.

Figure 8:
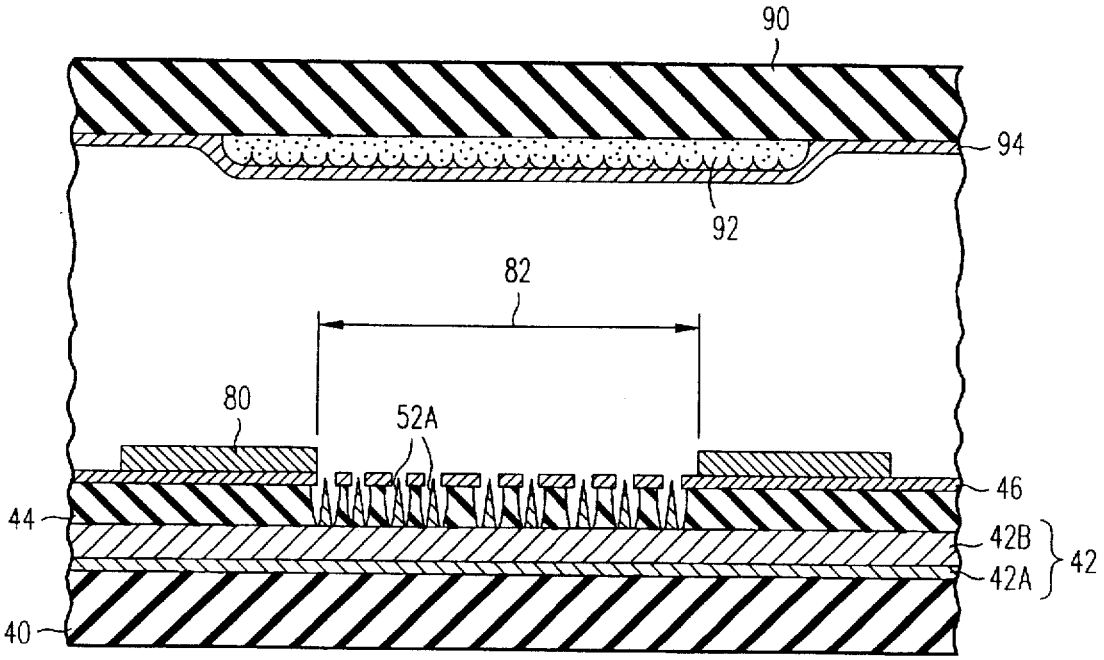
FIG. 8 is a cross-sectional structural view of a flat-panel CRT display that includes a gated field emitter having electron-emissive elements fabricated in accordance with the invention.

FIG. 8 depicts a typical example of the core active region of a flat-panel CRT display that employs an area field emitter, such as that of FIG. 5*d* (or 7), manufactured according to the invention. Substrate 40 forms the backplate for the CRT display. Lower non-insulating region 42 is situated along the interior surface of backplate 40 and consists of electrically conductive layer 42A and overlying electrically resistive layer 42B. One column electrode 80 is depicted in FIG. 8.

A transparent, typically glass, faceplate 90 is located across from baseplate 40. Light-emitting phosphor regions 92, one of which is shown in FIG. 8, are situated on the interior surface of faceplate 90 directly across from corresponding column-electrode aperture 82. A thin light-reflective layer 94, typically aluminum, overlies phosphor regions 92 along the interior surface of faceplate 90. Electrons emitted by electron-emissive elements 52A pass through light-reflective layer 94 and cause phosphor regions 92 to emit light that produces an image visible on the exterior surface of faceplate 90.

The core active region of the flat-panel CRT display typically includes other components not shown in FIG. 8. For example, a black matrix situated along the interior surface of faceplate 90 typically surrounds each phosphor region 92 to laterally separate it from other phosphor regions 92. Focusing ridges provided over interelectrode dielectric layer 44 help control the electron trajectories. Spacer walls are utilized to maintain a relatively constant spacing between backplate 40 and faceplate 90.

When incorporated into a flat-panel CRT display of the type illustrated in FIG. 8, a field emitter manufactured according to the invention operates in the following way. Light-reflective layer 94 serves as an anode for the field-emission cathode. The anode is maintained at high positive potential relative to the gate and emitter lines.

When a suitable potential is applied between (a) a selected one of the emitter row electrodes in lower non-insulating region 42 and (b) a selected one of the column electrodes that are constituted by or contact portions of gate layer 46, the so-selected gate portion extracts electrons from the electron-emissive elements at the intersection of the two selected electrodes and controls the magnitude of the resulting electron current. Desired levels of electron emission typically occur when the applied gate-to-cathode parallel-plate electric field reaches 20 volts/μm or less at a current density of 0.1 mA/cm$^2$ as measured at the phosphor-coated faceplate in the display when phosphor regions 92 are high-voltage phosphors. Upon being hit by the extracted electrons, phosphor regions 92 emit light.

Directional terms such as "lower" and "down" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, metals different from the preferred ones specified above could be selected for the emitter material of electron-emissive cones 52A and for the gate/column materials of gate layer 46 and (when present) the separate column electrodes by performing electrochemical removal tests on candidate metals using different electrolyte compositions and then examining the results, as in FIG. 4, to determine appropriate ranges of driving potential $V_{WE}$.

An electrochemical removal system containing a working-electrode conductor, a counter electrode, and a pair of counter-electrode conductors analogous to conductors 75 and 76, but no reference electrode (or reference-electrode conductor), could be used in place of the electrochemical removal system of FIG. 3. This variation simplifies the operational procedure and is particularly suitable for production-scale fabrication of electron emitters. Alternatively or additionally, it may be possible to delete counter electrode 70 (and associated conductor 76) in certain situations to achieve further simplification.

A counter electrode could be provided in the electron emitter itself, as part of substrate 40, instead of being situated in electrolyte 64 above excess layer 52C. Counter-electrode conductors 75 and 76 could be connected to separate terminals on control system 62 rather than being commonly connected through terminal CE.

A galvanostatic (constant-current) electrochemical removal system could be used in place of the potentiostatic system described above. Potentiostat control system 62 of FIG. 3 would be replaced with a galvanostat control system containing a current source that causes a substantially constant current to flow in working-electrode conductor 73 and counter-electrode conductor 76. Because the potential between working-electrode conductor 73 and counter electrode 70 in a galvanostatic system could rise to a value sufficient to electrochemically remove gate layer 46 and/or (when present) the separate column electrodes, the electrochemical removal operation would typically be terminated after a pre-selected removal time. Alternatively, a potential-measuring device could be included in the system for causing the removal process to terminate upon reaching a pre-selected potential between conductors 73 and 76.

The electrochemical removal system of FIG. 3 could be modified to cause a controllable potential to exist between working-electrode conductor 73 and counter-electrode conductor 76 rather than holding conductor 73 at a fixed potential. The potential between conductors 73 and 76 could be set at a fixed value during operation or could be programmably controlled.

The processes of FIGS. 2 and 5 could be revised to make electron-emissive elements of non-conical shape. As an example, the deposition of the emitter material could be terminated before fully closing the openings through which the emitter material enters dielectric openings 52. Electron-emissive elements 52A would then be formed generally in the shape of truncated cones. The electrochemical removal operation of the invention would subsequently be performed on excess emitter-material layer 52C with truncated cones 52A initially exposed to electrolyte 64 through apertures in layer 52C.

Any one or more of lithium nitrate ($LiNO_3$) potassium nitrate ($KNO_3$), rubidium nitrate ($RbNO_3$), and cesium nitrate ($CsNO_3$) could be substituted for, or utilized in combination with, sodium nitrate as the source of oxidizing ions. Likewise, any one or more of lithium hydroxide (LiOH), potassium hydroxide (KOH), or/and rubidium hydroxide (RbOH), and cesium hydroxide (CsOH) could be substituted for, or employed in combination with, sodium hydroxide as the base in electrolyte 64. Any one or more of the oxidizing agents could be used with any one or more of the bases. For any of these substitutions or combinations, the total molar concentrations of the oxidizing agents and bases would respectively be the same as described above for sodium nitrate and sodium hydroxide.

Nitrates of one or more Group II metals, particularly magnesium, calcium, strontium, and barium, could be used in electrolyte 64 instead of, or in addition to, the Group I metal nitrates described above. Likewise, hydroxides of one or more of these Group II metals could be used in electrolyte 64 in place of, or in addition to, the Group I metal hydroxides described above.

When performing the masked etch on blanket excess emitter-material layer 52B (prior to the electrochemical removal operation), the masked etch could be performed in such a way that (a) substantially all of each column electrode 80 is covered with excess emitter material rather than leaving only islands 52C of excess emitter material on electrodes 80 and (b) the excess emitter material is removed from the areas between electrodes 80. The electrochemical removal procedure of the invention may be performed long enough to create openings through patterned excess-emitter material layer 52C for exposing electron-emissive cones 52A but not long enough to remove all of layer 52C. By combining the two preceding variations, the remaining excess emitter material situated on column electrodes 80 can serve as parts of electrodes 80 to increase their current-conduction capability.

It may be desirable that electron-emissive cones have tips formed with emitter material, such as refractory metal carbide, that cannot readily be directly electrochemically removed. Titanium carbide is an attractive refractory carbide for the tips of the electron-emissive cones. In such a case, electrically non-insulating emitter material (such as molybdenum) that can be electrochemically removed is deposited over the top of the structure at the stage shown in FIGS. 2*a* or 5*a* and into dielectric openings 50 to form truncated conical bases for electron-emissive elements. The cone formation process is then completed by depositing the non-electrochemically removable material on top of the structure and into openings 50 until the apertures through which the material enters openings 50 fully close.

An electrochemical removal operation is then performed in the manner described above to remove the excess electrochemically removable emitter material situated directly on gate layer 46 and (when present) the separate column electrodes. During this operation, the excess non-electrochemically removable emitter material located along the top of the structure is lifted off. Consequently, conical electron-emissive elements having bases of electrochemically removable emitter material and tips of non-electrochemically removable emitter material are exposed through gate openings 48.

Provided that layer 32 in the prior art process of FIG. 1 consists of electrochemically removable material, the principles of the invention could be extended to electrochemically removing an intermediate layer, such as layer 32, situated between a gate layer and a layer containing excess emitter material. In such an extension, the excess material layer would typically be lifted off as a result of removing the intermediate layer. Any of the electrochemical removal systems described above could be employed in the so-extended process sequence.

Substrate 40 could be deleted if lower non-insulating region 42 is a continuous layer of sufficient thickness to support the structure. Insulating substrate 40 could be replaced with a composite substrate in which a thin insulating layer overlies a relatively thick non-insulating layer that furnishes structural support.

The electrochemical removal technique of the invention could be used in fabricating ungated electron emitters. The electron emitters produced according to the invention could be employed to make flat-panel devices other than flat-panel CRT displays. Various modifications and applications may thus be made by those skilled in the art without departing from the true scope and spirit of the invention as defined in the appended claims.

We claim:

1. A method comprising the steps of:

providing a structure in which (a) a first electrically non-insulating layer consisting at least partially of first material overlies an electrically insulating layer, (b) an opening extends through the insulating layer, and (c) an electrically non-insulating member consisting at least partially of the first material is at least partly situated in the opening and is spaced apart from the first non-insulating layer; and electrochemically removing at least part of the first material of the first non-insulating layer such that the non-insulating member is exposed without significantly chemically attacking the first material of the non-insulating member, the removing step being performed with an electrochemical cell containing an electrolytic bath to which the structure is subjected, operation of the cell being regulated by a control system having (a) a working-electrode conductor electrically coupled to the first non-insulating layer and (b) a first counter-electrode conductor electrically coupled to the non-insulating member.

2. A method as in claim 1 wherein the control system also has a second counter-electrode conductor electrically coupled to a counter electrode situated at least partly in the electrolytic bath and spaced apart from the structure, the second counter-electrode conductor being maintained at a controlled potential relative to the first counter-electrode conductor.

3. A method as in claim 1 wherein the structure includes a second electrically non-insulating layer situated between the first non-insulating layer and the insulating layer, an opening continuous with the opening through the insulating layer extending through the second non-insulating layer, the non-insulating member being spaced apart from the second non-insulating layer.

4. A method as in claim 3 wherein the second non-insulating layer is not substantially chemically attacked during the removing step.

5. A method as in claim 4 wherein the second non-insulating layer consists at least partially of second material chemically different from the first material.

6. A method as in claim 4 wherein substantially all of the first non-insulating layer is removed during the removing step.

7. A method as in claim 4 wherein the first non-insulating layer is electrically coupled to the second non-insulating layer.

8. A method as in claim 7 wherein the structure includes a lower electrically non-insulating region situated below the insulating layer, the non-insulating member being electrically coupled to the lower non-insulating region.

9. A method as in claim 8 wherein the control system has a working electrode electrically coupled to the second non-insulating layer.

10. A method as in claim 9 wherein the control system also has a second counter-electrode conductor electrically coupled to a counter electrode situated at least partly in the electrolytic bath and spaced apart from the structure, the second counter-electrode conductor being maintained at a controlled potential relative to the first counter-electrode conductor.

11. A method as in claim 10 wherein the removing step is performed in a substantially potentiostatic manner.

12. A method as in claim 10 wherein the removing step is performed in a substantially galvanostatic manner.

13. A method as in claim 10 wherein the first material consists primarily of molybdenum, and the second material consists primarily of chromium or/and nickel.

14. A method as in claim 13 wherein the controlled potential is zero, and the control system maintains the working-electrode conductor at substantially a selected driving potential relative to a Normal Hydrogen Electrode, the driving potential being in the range of 0.4–1.0 volt.

15. A method as in claim 14 wherein the electrolyte contains:

hydroxide of at least one of lithium, sodium, potassium, rubidium, and cesium at a molar concentration of 0.005–0.05; and nitrate of at least one of lithium, sodium, potassium, rubidium, and cesium at a molar concentration of 0.005–3.0.

16. A method comprising the steps of:

providing a structure in which (a) an electrically non-insulating gate layer overlies an electrically insulating layer situated over a lower electrically non-insulating emitter region, (b) a multiplicity of composite openings extend through the gate and insulating layers substantially down to the lower emitter region, (c) an excess layer consisting at least partially of primary electrically non-insulating emitter material overlies, and is electrically coupled to, the gate layer, and (d) a like multiplicity of electron-emissive elements are respectively situated in the composite openings, each electron-emissive element consisting at least partially of the primary emitter material, being electrically coupled to the lower emitter region, and being spaced apart from the gate and excess layers; and electrochemically removing, while the lower emitter region is at least partly present in the structure, at least part of the primary emitter material of the excess layer without significantly chemically attacking the primary emitter material of the electron-emissive elements and without substantially chemically attacking the gate layer.

17. A method as in claim 16 wherein the removing step is performed with an electrochemical cell containing an electrolytic bath to which the structure is subjected, operation of the cell being regulated by a control system having (a) a working-electrode conductor electrically coupled to the gate layer and (b) a first counter-electrode conductor electrically coupled to the lower emitter region.

18. A method as in claim 17 wherein the control system also has a second counter-electrode conductor electrically coupled to a counter electrode situated at least partly in the electrolytic bath and spaced apart from the structure, the second counter-electrode conductor being maintained at a controlled potential relative to the first counter-electrode conductor.

19. A method as in claim 17 wherein the removing step entails removing substantially all of the excess layer.

20. A method as in claim 17 wherein the providing step entails depositing the primary emitter material (a) over the gate layer to at least partly form the excess layer and (b) simultaneously into the composite openings to at least partly form the electron-emissive elements.

21. A method as in claim 17 wherein the gate layer at least partially consists of gate material chemically different from the primary emitter material.

22. A method as in claim 21 wherein the primary emitter material consists primarily of molybdenum, and the gate material consists primarily of chromium or/and nickel.

23. A method as in claim 22 wherein the controlled potential is zero, and the control system maintains the working-electrode conductor at substantially a selected driving potential relative to a Normal Hydrogen Electrode, the selected driving potential being in the range of 0.4–1.0 volt.

24. A method as in claim 23 wherein the electrolytic bath contains:

hydroxide of at least one of lithium, sodium, potassium, rubidium, and cesium at a molar concentration of 0.005–0.05; and nitrate of at least one of lithium, sodium, potassium, rubidium, and cesium at a molar concentration of 0.005–3.0.

25. A method as in claim 16 wherein the structure includes an additional electrically non-insulating layer situated between the excess and insulating layers and electrically coupled to the gate layer, the additional layer not being substantially chemically attacked during the removing step.

26. A method as in claim 25 wherein the additional layer is patterned into a group of parallel structure electrodes that selectively contact portions of the gate layer.

27. A method as in claim 26 wherein the primary emitter material in the excess layer is patterned into a like group of parallel lines, each overlying a corresponding one of the structure electrodes.

28. A method as in claim 27 wherein the removing step is performed for a time sufficiently long to expose the electron-emissive elements but not long enough to remove substantially all of the primary emitter material in the lines of the excess layer.

29. A method as in claim 25 wherein the primary emitter material consists primarily of molybdenum, the gate layer consists primarily of chromium, and the additional layer consists primarily of nickel or/and chromium.

30. A method as in claim 16 wherein each electron-emissive element comprises (a) a base of the primary emitter material and (b) a tip of further emitter material overlying the base, a layer of the further emitter material overlying the excess layer, the layer of further emitter material being removed during the removing step.

31. A method as in claim 30 wherein the further emitter material consists substantially of non-electrochemically removable material.

32. A method as in claim 30 wherein the further emitter material comprises refractory metal carbide.

33. A method as in claim 32 wherein the metal carbide comprises titanium carbide.

34. A method as in claim 16 wherein the lower emitter region comprises:

an electrically conductive layer patterned at least partially into emitter-electrode lines; and an electrically resistive layer overlying the conductive layer.

35. A method comprising the steps of:

providing a structure in which (a) a first electrically non-insulating layer comprising first material overlies an electrically insulating layer, (b) an opening extends through the insulating layer, and (c) an electrically non-insulating member comprising the first material is at least partly situated in the opening and is spaced apart from the first non-insulating layer; and electrochemically removing at least part of the first material of the first non-insulating layer such that the non-insulating member is exposed without significantly chemically attacking the first material of the non-insulating member, the removing step being performed by a procedure in which different first and second potentials that originate outside the structure are respectively applied to the non-insulating layer and the non-insulating member.

36. A method as in claim 35 wherein the removing step is performed with an electrochemical cell containing an electrolytic bath to which the structure is subjected.

37. A method as in claim 34 wherein the structure includes a second electrically non-insulating layer situated between the first non-insulating layer and the insulating layer, an opening continuous with the opening through the insulating layer extending through the second non-insulating layer, the non-insulating member being spaced apart from the second non-insulating layer.

38. A method as in claim 37 wherein the second non-insulating layer is not substantially chemically attacked during the removing step.

39. A method as in claim 38 wherein the second non-insulating layer comprises second material chemically different from the first material.

40. A method as in claim 38 wherein substantially all of the first non-insulating layer is removed during the removing step.

41. A method as in claim 38 wherein the first non-insulating layer is electrically coupled to the second non-insulating layer.

42. A method as in claim 41 wherein the structure includes a lower electrically non-insulating region situated below the insulating layer, the non-insulating member being electrically coupled to the lower non-insulating region.

43. A method as in claim 42 wherein the second potential is transmitted to the non-insulating member through the lower non-insulating region.

44. A method comprising the steps of:

providing a structure in which (a) an electrically non-insulating gate layer overlies an electrically insulating layer situated over a lower electrically non-insulating emitter region, (b) a multiplicity of composite openings extend through the gate and insulating layers substantially down to the lower emitter region, (c) an excess layer comprising primary electrically non-insulating emitter material overlies, and is electrically coupled to, the gate layer, and (d) a like multiplicity of electron-emissive elements are respectively situated in the composite openings, each electron-emissive element comprising the primary emitter material, being electrically coupled to the lower emitter region, and being spaced apart from the gate and excess layers; and electrochemically removing at least part of the primary emitter material of the excess layer without significantly chemically attacking the primary emitter material of the electron-emissive elements and without substantially chemically attacking the gate layer, the removing step being performed by a procedure in which different first and second potentials that originate outside the structure are respectively applied to the gate layer and the lower emitter region.

45. A method as in claim 44 wherein the removing step is performed with an electrochemical cell containing an electrolytic bath to which the structure is subjected.

46. A method as in claim 45 wherein the removing step entails removing substantially all of the excess layer.

47. A method as in claim 45 wherein the providing step entails depositing the primary emitter material (a) over the gate layer to at least partly form the excess layer and (b) simultaneously into the composite openings to at least partly form the electron-emissive elements.

48. A method as in claim 45 wherein the gate layer at least partially consists of gate material chemically different from the primary emitter material.

49. A method as in claim 44 wherein the structure includes an additional electrically non-insulating layer situated between the excess and insulating layers and electrically coupled to the gate layer, the additional layer not being substantially chemically attacked during the removing step.

50. A method as in claim 49 wherein the additional layer is patterned into a group of parallel structure electrodes that selectively contact portions of the gate layer.

51. A method as in claim 44 wherein the lower emitter region comprises:

an electrically conductive layer patterned at least partially into emitter-electrode lines; and an electrically resistive layer overlying the conductive layer.

* * * * *